United States Patent [19]

Maki

[11] Patent Number: 4,760,362

[45] Date of Patent: Jul. 26, 1988

[54] LEAKY COAXIAL CABLE PROVIDING INDUCTIVE COUPLING BY ELIMINATING RADIATING GAPS, AND THE METHOD OF MAKING SAME

[75] Inventor: Melvin C. Maki, Kanata, Canada

[73] Assignee: Control Data Canada Limited, Ottawa, Canada

[21] Appl. No.: 799,693

[22] Filed: Nov. 19, 1985

[30] Foreign Application Priority Data

Jan. 14, 1985 [CA] Canada ..... 472030

[51] Int. Cl.[4] ..... H01P 3/06

[52] U.S. Cl. ..... 333/237; 343/895; 343/790; 57/3; 156/53

[58] Field of Search ..... 333/237, 236; 343/767, 343/770, 771, 790, 895; 342/27; 340/552; 156/52, 53, 55, 56, 47; 57/3

[56] References Cited

U.S. PATENT DOCUMENTS

| | | | |
|---|---|---|---|
| 3,681,717 | 8/1972 | Martin | 333/237 |
| 3,735,293 | 8/1973 | Breitenbach | 333/237 |
| 3,870,977 | 3/1975 | Peoples et al. | 333/237 |
| 3,949,329 | 4/1976 | Martin | 333/237 |
| 4,157,518 | 6/1979 | McCarthy | 333/237 |
| 4,300,338 | 11/1981 | Harman et al. | 57/3 |
| 4,339,733 | 7/1982 | Smith | 333/237 |
| 4,368,613 | 1/1983 | Sanchez | 57/3 X |
| 4,432,193 | 2/1984 | Maki | 57/3 |

FOREIGN PATENT DOCUMENTS

| | | | |
|---|---|---|---|
| 0077622 | 6/1977 | Japan | 333/237 |

*Primary Examiner*—Eugene R. LaRoche
*Assistant Examiner*—Benny T. Lee
*Attorney, Agent, or Firm*—Jones, Tullar & Cooper

[57] ABSTRACT

A leaky coaxial cable is designed to produce a defined coupling between its interior and exterior. A bonded and insulated outer conductor of relatively large width relative to the cable diameter, is spirally wound at a low pitch angle to provide at high frequencies a coupling level having minimal effect on the coaxial properties of the cable.

12 Claims, 2 Drawing Sheets

LEAKY COAXIAL CABLE PROVIDING INDUCTIVE COUPLING BY ELIMINATING RADIATING GAPS, AND THE METHOD OF MAKING SAME

BACKGROUND OF THE INVENTION

This invention relates to leaky coaxial cables such as are used for guided communications, obstacle detection, and perimeter security. Specifically, the present invention relates to a leaky coaxial cable having a bonded outer shield formed by a conductive tape wound at a low pitch angle in a spiral path along the cable length.

Leaky coaxial cables, sometimes known as ported coaxial cables or radiating coaxial cables, are generally constructed with gaps or apertures in their outer shield which permit a portion of the internal field to couple to the external environment and external fields to couple to the cable. For example, U.S. Pat. No. 4,300,338 discloses a design with rhombic shaped apertures in the outer conductor. Both inductive and capacitive coupling is produced having a magnitude dependent on the size, shape, orientation and density of the apertures.

Leaky coaxial cables can be produced with thin, solid, tubular outer shields, as shown in U.S. Pat. No. 3,681,717, in which there is diffusion coupling through the shield due to its thickness being of the same order as, or smaller than, the skin depth at the frequency of operation. Finally, it is known that by use of a spiral or solenoidal construction path along the outer conductor inductive coupling can be produced with no aperture or gap necessarily being present. U.S. Pat. No. 3,735,293, for example, shows a cable having an outer conductor formed from closely wound metal tape with an insulating backing.

In the design of all such cables it is desired to produce a defined level of coupling with minimal effect on such coaxial cable parameters as impedance, velocity of propagation and downline attenuation. The primary components of attenuation in non-leaky cables are due to conductor and dielectric losses, but in leaky coaxial cables losses also occur due to coupling with the external environment. The presence of apertures, since they result from metal removal from the conduction path, cause an inherent increase in attenuation.

Models of coupled transmission lines indicate that the capacitive coupling inherent with apertures or longitudinal gaps is generally undesirable. This coupling varies with the dielectric constant of the materials external to the cable and, thus, produces undesirable environmental sensitivity. Capacitive may also reduce the signals transferred by inductive coupling by producing components of opposite phase to them. Finally, capacitive coupling also produces a loss which contributes to attenuation.

Diffusion coupling cables are limited in leaky cable applications both because the resulting coupling is weak and a substantial increase in attenuation results from the requirement that the thickness of the outer shield must be reduced.

Cables relying on a solenoidal conductive path in the outer conductor, called induction cables, have been restricted to use at low frequencies, because the resulting large inductive coupling increases linearly with frequency. This has been found to cause large mismatch effects and high coaxial attenuation due to a high degree of coupling when used in the frequency range of typical applications, greater than 30 MHz. Frequencies in the 30–200 MHz band are used for the detection of humans or obstacles which have a dimension of approximately $\frac{1}{4}$ wavelength in this band. Also coaxial attenuation is inherently high for cables using high pitch angle conductors to produce the solenoidal currents since the conductor path is long. Typical application angles for spiral tapes in normal manufacturing practice is in the range of 30–70 degrees (e.g. U.S. Pat. Nos. 3,735,293, 3,949,329 and 3,870,977). Coaxial attenuation increases approximately as the inverse of the cosine squared of the pitch angle for full coverage spiral tapes.

For many applications it is desirable to be able to 'grade' or modulate the cable coupling, as shown in U.S. Pat. No. 4,432,193, by varying some cable parameters with length. This can, for example, be used to compensate for cable attenuation so that the external field along the cable from the signal input is maintained of uniform magnitude.

SUMMARY OF THE INVENTION

It is a feature of the present invention to provide a leaky coaxial cable exhibiting low coaxial attenuation together with coupling levels that are sufficient for detection, without resulting in undesirable variations in the other cable parameters.

Specifically, the invention relates to a leaky coaxial cable having a central conductor, a dielectric layer therearound and an outer conducting shield. The shield comprises conductive tape arranged in spiral configuration with adjacent edges insulated from one another, the pitch angle of the tape with respect to the longitudinal axis of the cable being less than 30°.

In its method aspect the invention relates to a method of providing a leaky coaxial cable having an acceptable level of inductive coupling, low capacitive coupling and low attenuation. The cable has an outer conducting shield formed from conductive tape arranged in spiral configuration. The method comprises the steps of: providing a conductive tape having a tape width to cable circumference ratio sufficiently high to provide the low level of capacitive coupling; and winding the tape at a pitch angle below 30° to provide the acceptable level of inductive coupling.

The use of such low pitch angles has the following advantages. Coupling levels, which increase approximately in a linear manner with frequency and as the square of the tangent of pitch angle, are sufficient for detection, yet do not detrimentally affect the coaxial cable properties. Conductor losses, which vary approximately inversely as the cosine squared of the pitch angle, are not excessive at this low angle, and hence coaxial attenuation, which has components due to both this and to coupling losses, is low.

Because of the difficulty of applying and retaining wide tapes at such low angles the conductor is typically bonded both to the dielectric layer, and to itself, providing mechanical stability during production and flexing in use. The bonding also serves to provide protection of the underlying dielectric from moisture ingress from the environment. The full surface coverage of the dielectric by the outer conductor results in almost no capacitive coupling, and hence negligible losses and adverse interaction effects due to this factor. In referring to conductive tape it is intended to include also served or braided wires which function in the same manner.

BRIEF DESCRIPTION OF THE DRAWINGS

Particular embodiments of the invention will be described in conjunction with the accompanying drawings, in which.

DESCRIPTION OF THE PREFERRED EMBODIMENT

Figure 1:
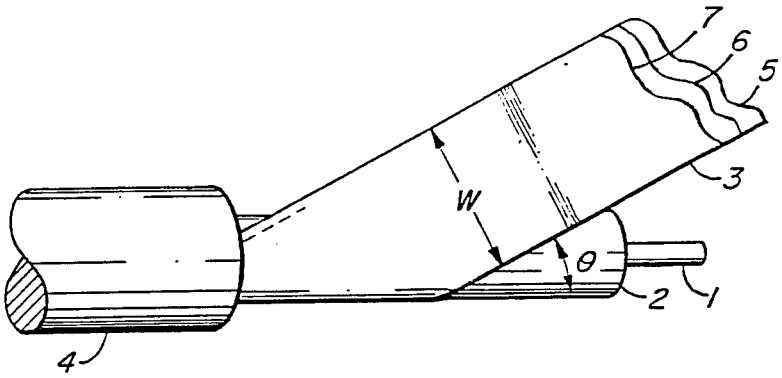
FIG. 1 shows the construction of a leaky coaxial cable in accordance with the present invention.

FIG. 1 shows the construction of a leaky coaxial cable in accordance with the invention. A centre conductor 1 has a concentric dielectric layer 2 formed thereabout. The centre conductor is typically but not necessarily copper, copper-clad aluminum, copper-clad steel, or aluminum. The insulating dielectric layer is typically a solid, foamed or air-spaced plastic compound such as polyethylene, polypropylene, or Teflon. A laminated tape 3 is spirally wound about the dielectric layer. The tape 3 has layers, from the inside to the outside of adhesive 5, a non-conductive plastic such as mylar, polyester or polypropylene 6, bonded to a conductor 7 such as copper or aluminum. The insulating plastic is not a necessary element if the adhesive itself provides an insulating layer and the conductor is of adequate thickness for mechanical strength. When the tape is wound with a width W and a pitch angle $\theta$, the relationship between these parameters and C the cable circumference at the dielectric layer is maintained so that:

$$\frac{W}{C\cos\theta} \approx 1 \qquad (1)$$

This allows edges of adjacent turns to be in close proximity to one another, located between the limits of being slightly gapped and having slight overlap. In any case there is no conducting path short circuiting the turn.

The conductive tape thickness can be selected to be several multiples of the skin depth at the frequency of operation to minimize attenuation. The tape layer 3 may be covered with an insulating dielectric jacket 4 to provide mechanical protection. It will be clear that the relative location of the adhesive is not critical to the invention. It could be applied to the dielectric layer or on the outside of the tape at least on the portions which overlap. An additional dielectric flooding compound can be introduced between the tape layer and jacket to provide moisture protection and, again as an option, the adhesive layer or additional adhesive layers can be formed between the tape and the jacket.

Figure 2:
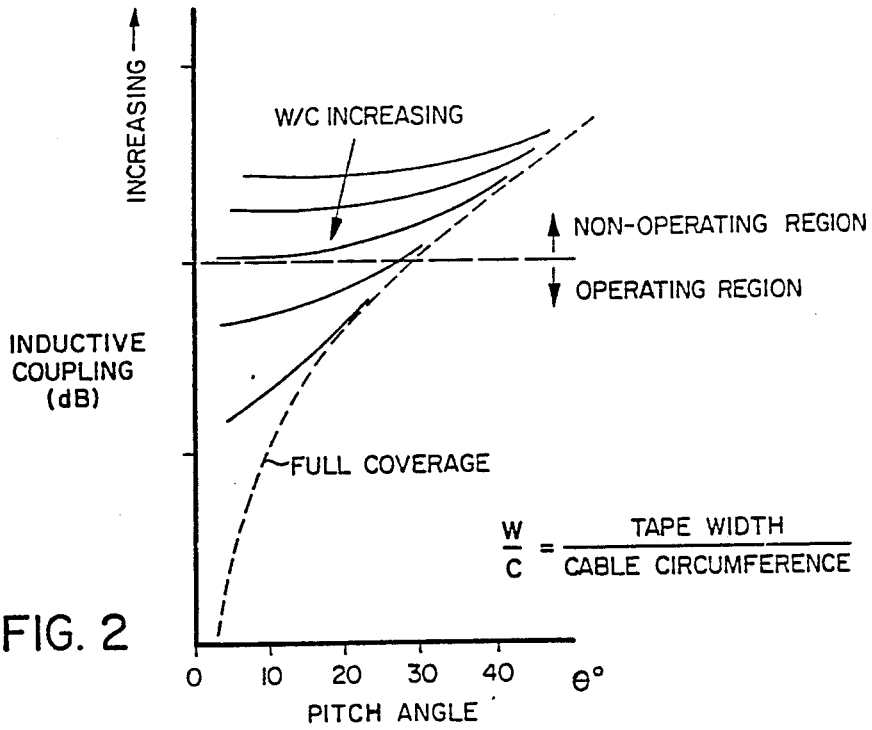
FIG. 2 is a graph showing inductive coupling at one frequency as a function of the tape width and pitch angle.
Figure 3:
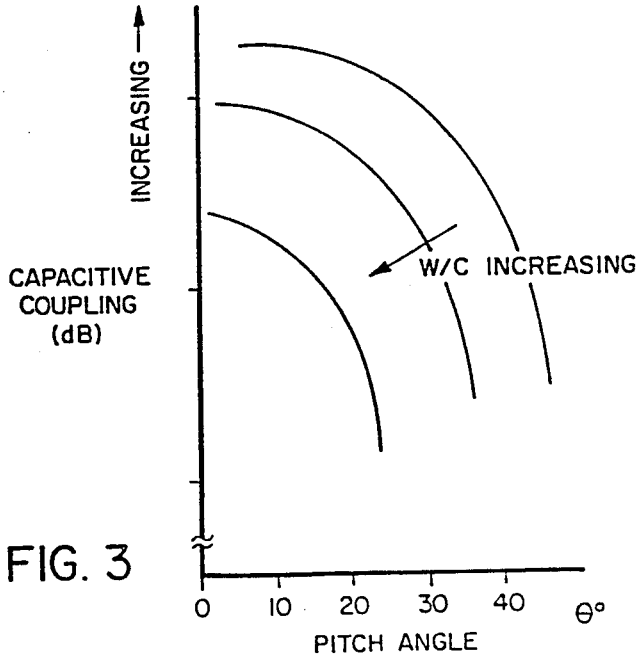
FIG. 3 is a graph showing capacitive coupling as a function of the same cable parameters.

The tape pitch and width are selected with regard to the data shown in FIGS. 2 and 3. FIG. 2 shows the inductive coupling as a function of the outer conductor tape width and pitch angle. High coupling is produced with a narrow ($W/C << 1$) tape or wire wound at high pitch angle. From experience with leaky cables it has been found that cables constructed with parameters in the upper region of the plot exhibit extremely high coupling, producing strong interaction with the environment and unacceptable changes in coaxial properties such as impedance and attenuation. Cables that are constructed in accordance with the present invention require very wide tapes and very low pitch angles as indicated by the operating region of the plot.

FIG. 3 shows the related capacitive coupling as a function of tape width and pitch angle. High capacitive coupling is also produced with a narrow ($W/C << 1$) tape or served wires. At a constant tape width, capacitive coupling decreases as the pitch angle, and hence physical coverage of the tape, increases. For the desired minimum capacitive coupling at a particular tape width the curve indicates that the maximum available full coverage tape pitch angle be used, as the curve assymptotically approaches zero at this angle.

The results of FIGS. 2 and 3 taken together require the leaky cable to be such that the tape pitch angle is typically in the range of 5 to 30 degrees, parameter W/C typically in the range of 0.5 to 1.1 almost full coverage or a slight overlap maintained on the dielectric surface.

Figure 4:
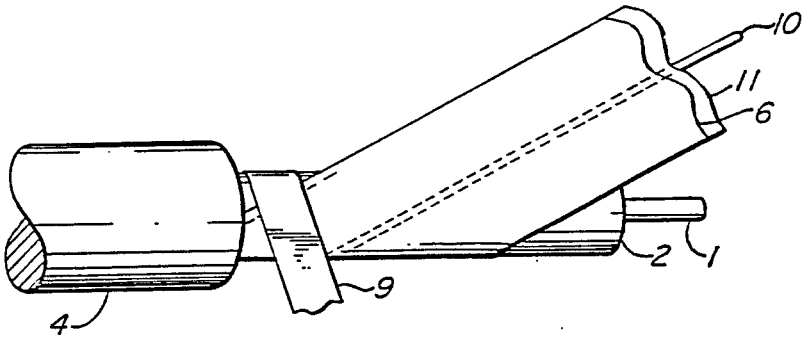
FIG. 4 shows an alternative construction of a leaky coaxial cable including a drain wire and retaining tape.

In FIG. 1 the adhesive layer 5 is used primarily to ensure tapes of such extremely high width and low pitch angle can be retained in the prescribed position. It also serves as a protective barrier to prevent moisture ingress to the dielectric. An alternative construction of the leaky cable is shown in FIG. 4. In this construction the outer conductor, from the inside out, consists of a metallic drain wire conductor 10 in contact with a laminated tape consisting of a metallic conductive layer 11 in contact with the drain wire, and an insulating layer 6 providing insulation between turns. The drain wire and laminated tape are wound at pitch angles selected in accordance with the above range. To affix the laminate in the desired position relative to the dielectric an insulating tape 9 is wound at a relatively higher pitch than the laminated tape. This tape 9 can be wound either with the same or opposite lay (direction of twist) as the laminated tape. The drain wire performs its conventional function of ensuring that the surface formed by the tape is at a uniform electrostatic potential. It will be clear that the order of the conducting layer and insulating layer can be reversed and the cable will function in the same manner.

Other methods of mechanical restraint for the spiral tape are possible. For example, it is possible to interlock the adjacent insulated edges of the conductor as in armouring or folding, or to extrude a dielectric sleeve or jacket directly over the conductor immediately after it has been applied.

Similar constructions using the present invention include the use of commercially available laminate tapes having several conductive and insulating layers of same or different widths or the use of more than one parallel spiral conductive tape or served wires. The latter could be used, for example, to improve mechanical characteristics such as flexibility. The same low pitch angle and coverage are required.

Figure 5:
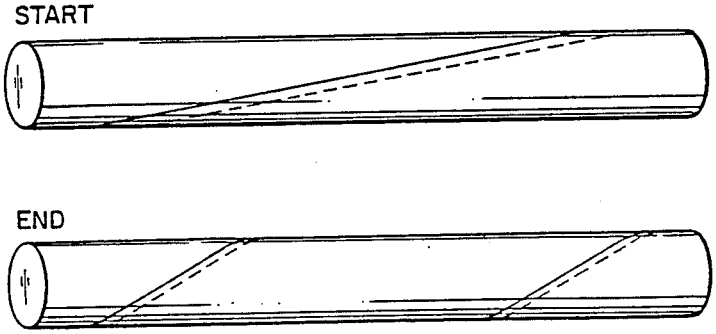
FIG. 5 shows the manner of grading a leaky coaxial cable in accordance with this invention.

Grading or modulation of the leaky cable can also be achieved by ensuring that the inductive coupling is modified with distance along the cable relative to the incremental coaxial attenuation at the frequency of operation. Referring to FIG. 2 it is evident that coupling can be increased by moving up the full coverage line from a low to higher pitch angle and decreasing tape width. FIG. 5 shows the outer conductive tape at two different sections along a radiating cable constructed to provide for constant sensitivity along the cable length. The information of FIGS. 2 and 3, as well as information relating to attenuation at the frequency of operation is used to derive the precise variation of tape width and pitch angle with distance along the cable.

While preferred embodiments of the present invention have been illustrated and described, to those skilled in the art changes may be made without departing from the broader aspects of the invention. The following claims define these broader aspects. In these claims adjacent edges of successive turns are defined as "closely spaced". This is intended to encompass a range of configurations in which successive turns can overlap and in which the edges of successive turns can lie side-by-side with a small spacing between them.

I claim:

1. A leaky coaxial cable having inductive coupling, comprising:

a central conductor extending along a longitudinal axis;

a dielectric layer disposed coaxially around the central conductor; and an outer coaxial conducting shield, the shield comprising a tape of selected width having a continuous, imperforate conductive layer and an insulating layer, said tape being arranged in a spiral configuration to provide inductive coupling, with abutting edges of the conductive layer in the spiral configuration overlapping so as to substantially eliminate radiating gaps and being insulated from one another by said insulating layer, the pitch angle of the tape with respect to the longitudinal axis of the cable being less than 30°.

2. A leaky coaxial cable having:

a central conductor extending along a longitudinal axis;

a dielectric layer disposed coaxially around the central conductor; and an outer coaxial conducting shield, the shield comprising a tape of selected width having a continuous imperforate conductive layer and an insulating layer, said tape being arranged in a spiral configuration to provide inductive coupling, the abutting edges of the conductive layer in the spiral configuration being sufficiently closely spaced to substantially eliminate radiating gaps therebetween, thereby preventing radiation between adjacent edges, said abutting edges being insulated from one another, the pitch angle of the tape with respect to the longitudinal axis of the cable being less than 30° to provide an acceptable level of inductive coupling with minimum capacitive coupling.

3. A leaky coaxial cable as set out in claim 2, wherein the abutting edges are side by side and insulated from one another.

4. A leaky coaxial cable as set out in claim 2, wherein the tape is laminated and comprises adhesive, insulating and conductive layers arranged in that order from the dielectric layer to the outside of the cable whereby the adhesive layer bonds to the dielectric layer to hold the laminated tape in place.

5. A leaky coaxial cable as set out in claim 2, wherein the tape is laminated and further includes a conductive drain wire wound with and in electrical contact with the conductive layer and external means holding the laminated tape in place.

6. A leaky coaxial cable as set out in claim 5, wherein the drain wire, the conductive layer and the insulating layer are arranged in that order from the dielectric layer to the outside of the cable.

7. A leaky coaxial cable as set out in claim 5, wherein the insulating layer, the conductive layer and the drain wire are arranged in that order from the dielectric layer to the outside of the cable.

8. A leaky coaxial cable as set out in claim 5, claim 6 or claim 7, wherein the external means holding the laminated tape in place is an insulating tape wound thereover.

9. A leaky coaxial cable as set out in claim 5, claim 6 or claim 7, wherein the external means holding the laminated tape in place is a dielectric sleeve or jacket.

10. A leaky coaxial cable as set out in claim 1, claim 2, or claim 3 wherein one of the tape width and pitch angle is varied along the length of the cable to provide a cable with coupling characteristics varying with distance along the cable.

11. A leaky coaxial cable as set out in claim 1, claim 2, or claim 3 wherein both the tape width and pitch angle are varied along the length of the cable to provide a cable with coupling characteristics varying with distance along the cable.

12. A method of constructing a leaky coaxial cable comprising the steps of:

(a) providing a core consisting of a central conductor and a dielectric layer disposed coaxially thereon;

(b) providing a laminated tape of selected width and having a conductive layer and an insulating layer, the ratio of the tape width to the circumference of said coaxial cable being selected to produce a low level of capacitive coupling in the assembled cable;

(c) winding the tape coaxially around said core at a predetermined pitch angle below 30°, with adjacent edges being sufficiently closely spaced to substantially eliminate radiating gaps therebetween, said edges being insulated from one another, so as to provide an acceptable level of inductive coupling; and (d) said winding of the tape being with sufficient surface coverage to provide a low level of capacitive coupling.

* * * * *